US007533621B2

(12) United States Patent
Trobaugh, III

(10) Patent No.: US 7,533,621 B2
(45) Date of Patent: May 19, 2009

(54) RUG SEWING APPARATUS

(75) Inventor: Robert A. Trobaugh, III, Hampton Cove, AL (US)

(73) Assignee: Maples Industries, Inc., Scottsboro, AL (US)

( * ) Notice: Subject to any disclaimer, the term of this patent is extended or adjusted under 35 U.S.C. 154(b) by 0 days.

(21) Appl. No.: 11/670,437

(22) Filed: Feb. 2, 2007

(65) Prior Publication Data

US 2008/0184922 A1 Aug. 7, 2008

(51) Int. Cl.
*D05B 35/06* (2006.01)
*D05B 27/00* (2006.01)

(52) U.S. Cl. ..... 112/475.08; 112/475.06; 112/122

(58) Field of Classification Search ..... 112/418, 112/2.1, 9, 10, 152, 153, 147, 122.1, 288, 112/122, 217, 475.06, 475.08; 156/93
See application file for complete search history.

(56) References Cited

U.S. PATENT DOCUMENTS 3,203,381 A * 8/1965 Crane et al. ..... 112/122
3,221,685 A * 12/1965 Greenberg ..... 112/138
3,262,739 A * 7/1966 Crane ..... 297/452.43
3,554,148 A * 1/1971 Johnson, Jr. ..... 112/137
3,712,254 A * 1/1973 Beamish et al. ..... 112/470.36
3,789,782 A * 2/1974 Speer ..... 112/130
4,594,955 A * 6/1986 Lichtenberg ..... 112/147
4,688,499 A 8/1987 Moore et al.
4,823,713 A * 4/1989 Ogawa et al. ..... 112/217
4,895,088 A * 1/1990 Pirrello et al. ..... 112/130
4,905,615 A * 3/1990 Pofferi ..... 112/2.1
5,018,462 A * 5/1991 Brocklehurst ..... 112/470.07
5,216,969 A * 6/1993 Thomas et al. ..... 112/7
5,394,813 A 3/1995 Shimoyama et al.
5,448,960 A * 9/1995 Navlyt et al. ..... 112/475.03
5,582,121 A * 12/1996 Nanjo et al. ..... 112/288
5,609,117 A * 3/1997 Suzuki ..... 112/288
5,645,002 A 7/1997 Brocklehurst
6,014,938 A * 1/2000 Uto ..... 112/470.18
6,044,783 A * 4/2000 Moniz ..... 112/475.06
6,283,054 B1 9/2001 Engle
6,499,416 B2 12/2002 Stewart et al.
6,517,651 B2 * 2/2003 Azulay ..... 156/73.1
6,743,322 B2 6/2004 Sloot
6,848,378 B2 2/2005 Kirkland et al.

* cited by examiner

*Primary Examiner*—Ismael Izaguirre
(74) *Attorney, Agent, or Firm*—Sutherland Asbill & Brennan LLP

(57) ABSTRACT

A work piece finishing apparatus including a cutter assembly, a binding tape applier, and a flat bed sewing head.

20 Claims, 6 Drawing Sheets

RUG SEWING APPARATUS

TECHNICAL FIELD

The present application relates generally to a rug sewing device and more particularly relates to a rug sewing device that automatically cuts a work piece, adds a binding tape to the work piece, sews the work piece, and cuts the excess binding tape.

BACKGROUND OF THE INVENTION

Although numerous attempts have been made to automate the finishing products for textiles, carpeting, and similar types of materials, these attempts have not always been successful with respect to quality control and/or with respect to production time. For example, the binding tape used in the manufacture of square rugs generally extends beyond the corners in an automated system. As a result, each rug must be individually finished in a time consuming process. Specifically, the operators need to manually fold back the tape and sew it down in a bar-track unit. Likewise with respect to rugs with rounded edges, the entire rug generally must be die cut or cut by some other manual means before being finished. This additional finishing step also adds to the overall production time.

Thus, there is a desire for automatic finishing devices and methods for textile products. The improved devices and methods preferably can complete the finishing process in an automated fashion for work pieces with square finishes, rounded finishes, or any desired finish. The devices and methods should be able to finish the work piece in a high speed and efficient manner while accommodating variations in the work piece itself.

SUMMARY OF THE INVENTION

The present application thus describes a work piece finishing apparatus. The work piece finishing apparatus may include a cutter assembly, a binding tape applier, and a flat bed sewing head.

The flat bed sewing head may include a cantilevered arm. The binding tape applier may include a tape folder. The cutter assembly may include a cutter arm with a driven knife thereon as well as a fixed knife. The work piece finishing apparatus further may include a binding tape separator. The binding tape separator may include a sonic separator/sealer and an anvil. The work piece finishing apparatus further may include a thread chain cutter. The work piece finishing apparatus further may include a maneuvering system so as to maneuver the work piece about the cutter assembly, the binding tape applier, and the flat bed sewing head. The maneuvering system may include a gantry arm assembly with a template. A drive wheel positioned about the flatbed sewing head cooperates with the maneuvering system.

The present application further describes a method for finishing the edges of a work piece. The method may include trimming the edges of the work piece, applying a binding tape to the edges, stitching the binding tape, removing any excess binding tape along the one or more corners of the work piece and sealing the corners.

The trimming step may include cutting a square corner on the work piece. The stitching step may include stitching the binding tape with a flat bed sewing head. The sealing step may include sonically sealing the corners.

The present application further describes a method for finishing the edges of a work piece. The method may include trimming the work piece to form rounded edges, applying a binding tape to the edges, and stitching the binding tape with thread and a flat bed sewing head.

The method further may include maneuvering the work piece across a tabletop and through the flat bed sewing head with a maneuvering system in combination with a sewing head drive wheel. The method also may include removing any excess thread with a chain cutter.

These and other features of the present application will become apparent to one of ordinary skill in the art upon the review of the following detailed description when taken in conjunction with the several drawings and appended claims.

DETAILED DESCRIPTION

Figure 1:
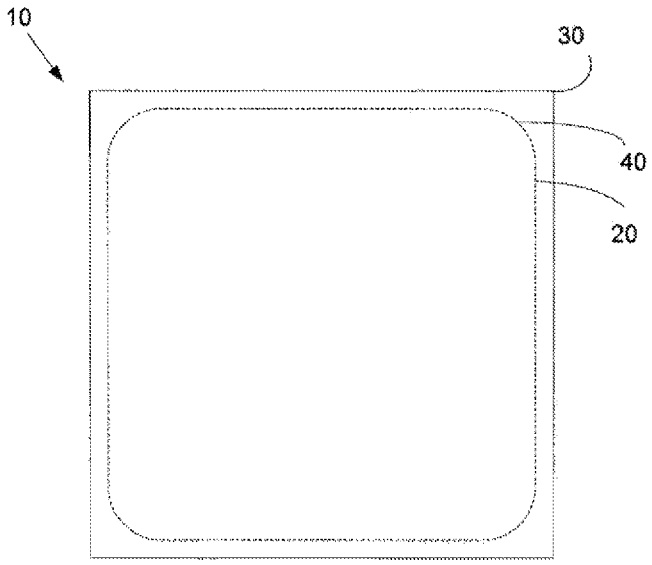
FIG. 1 is a schematic view of a work piece.
Figure 2A:
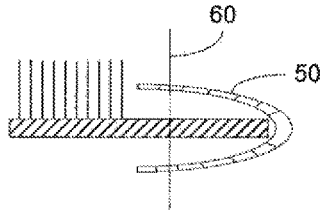
FIGS. 2A-C are side cross-sectional views of a finished work piece.
Figure 2B:
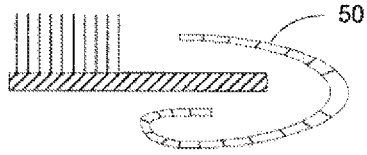
Figure 2C:
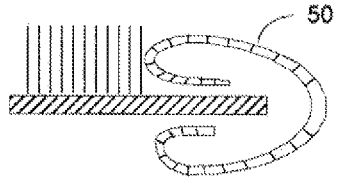
Figure 3:
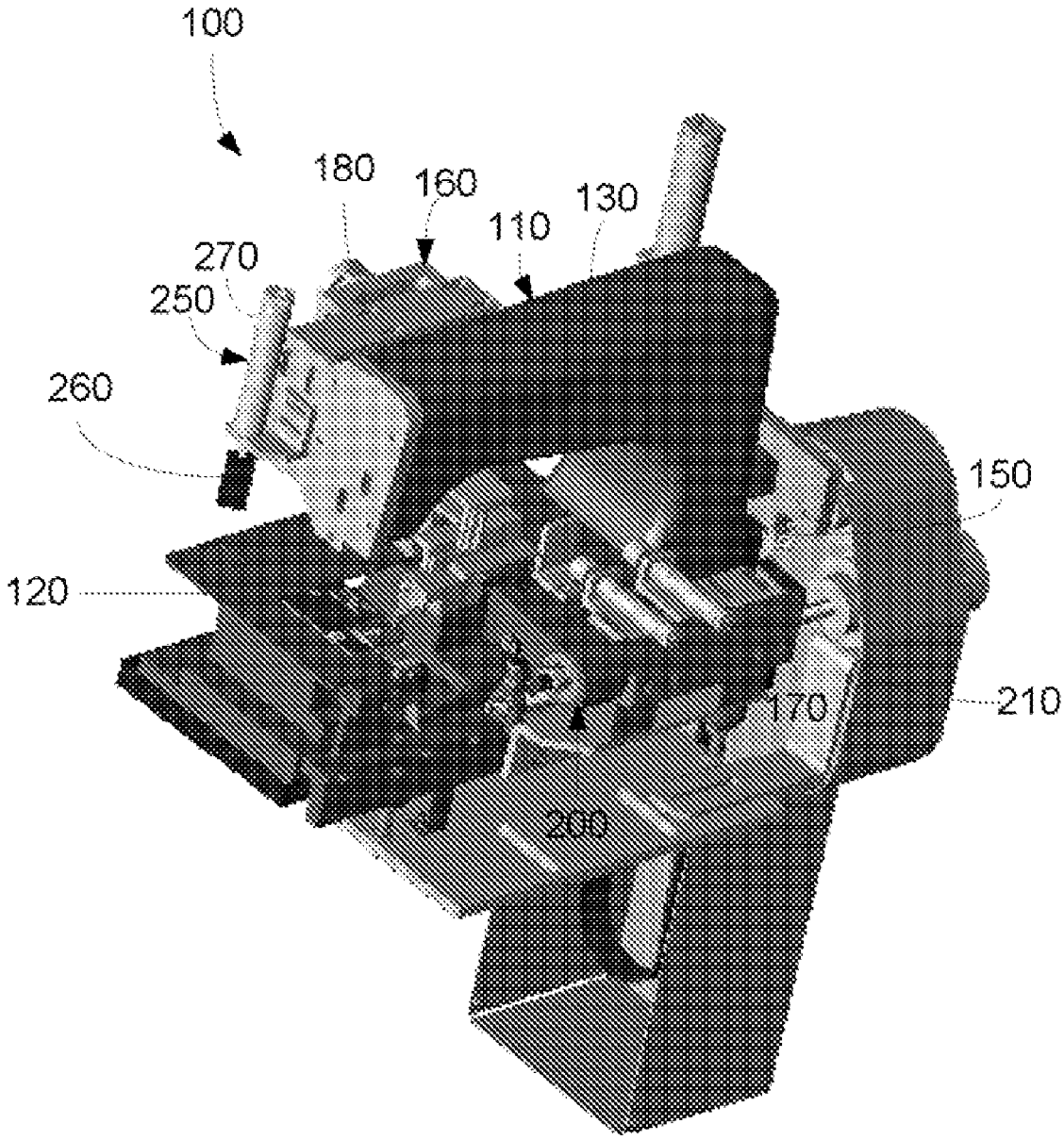
FIG. 3 is a perspective view of the finishing apparatus as is described herein.
Figure 4:
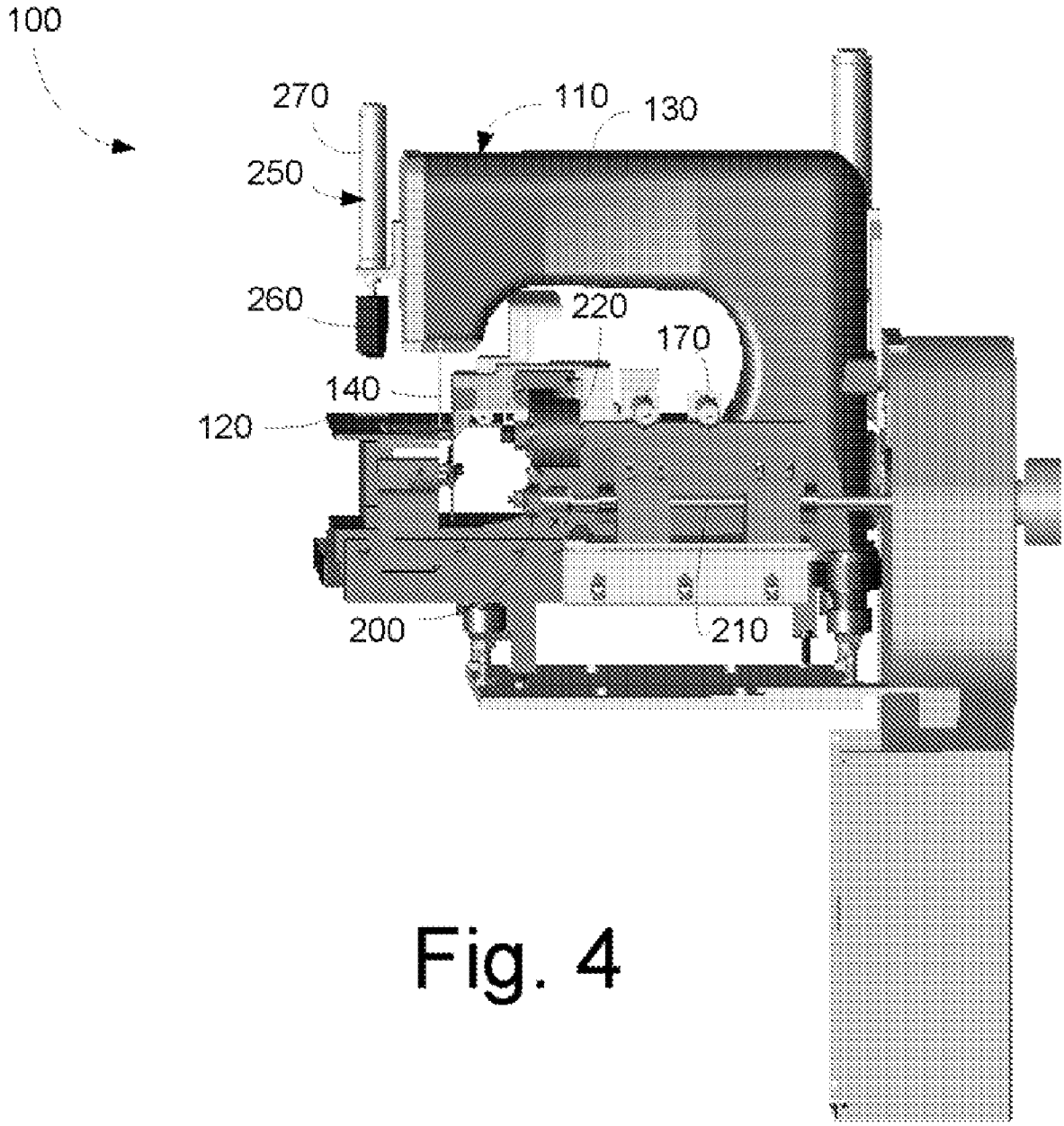
FIG. 4 is a side plane view of the finishing apparatus of FIG. 3.
Figure 5:
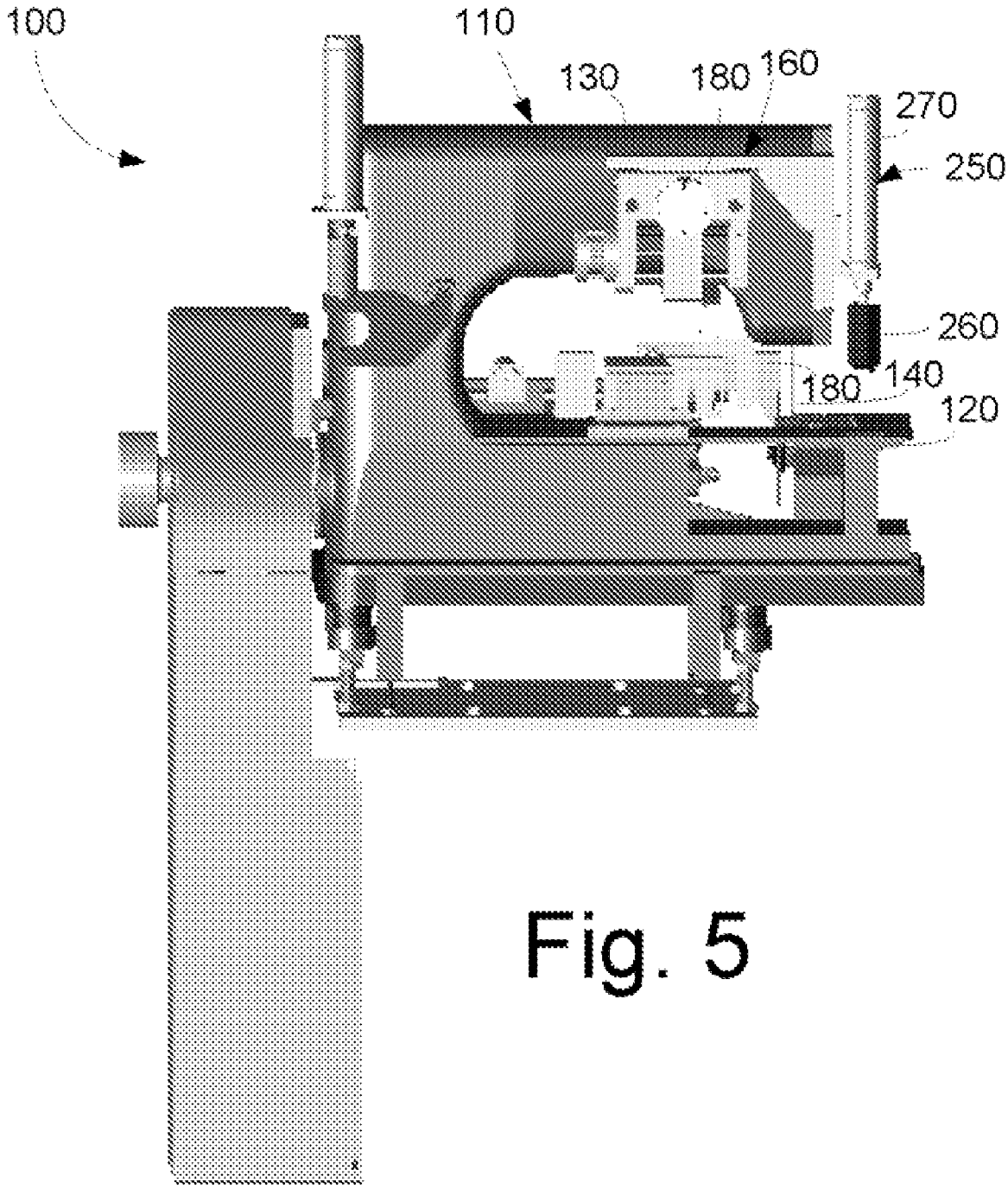
FIG. 5 is a side plan view of the finishing apparatus of FIG. 3.
Figure 6:
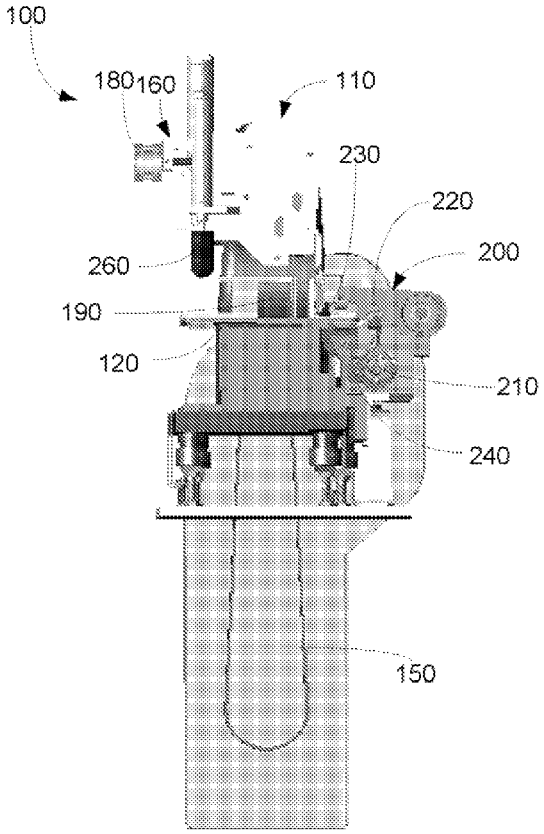
FIG. 6 is a front plan view of the finishing apparatus of FIG. 3.
Figure 7:
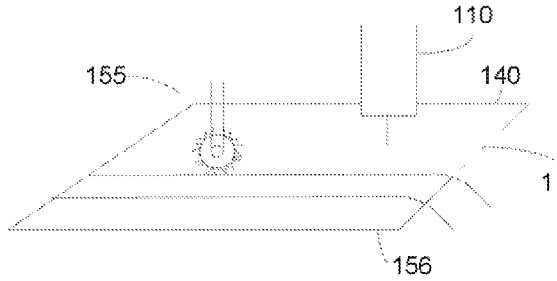
FIG. 7 is a schematic view of the drive wheel and the drive tape assembly positioned about the work surface.

Referring now to the drawings, in which like numeral refer to like elements throughout the several views, FIG. 1 shows a work piece 10 to be finished herein. The work piece 10 generally is a textile product such as a rug, a mat, or similar item. The present application, however, has applicability outside the textile field. The individual work piece 10 is generally cut from a continuous roll of a work piece material. The work piece 10 also may have a rubber-like material on one side. It is generally desired to trim the work piece 10 to a final shape 20. The final shape 20 may have square corners 30 or rounded corners 40. Any desired shape may be used herein. A binding tape 50 is generally added to the outer edge of the final shape 20 as is shown in FIGS. 2A-2C. The binding tape 50 may be made from a thermoplastic material. The binding tape 50 is then sewn/taped into place via a stitch 60 and the excess binding tape 50 is removed.

FIGS. 3-8 shows a finishing apparatus 100 as is described herein. The finishing apparatus includes a flatbed sewing head 110. An example of a flat bed sewing head 110 is sold by Union Special of Huntley, Ill. under the designation "Model 56300G" with a binding tape guide. JUKI Corporation of Tokyo, Japan also sells a flat bed sewing head. Generally described, a flat bed sewing head 110 includes a relatively flat extended work surface 120 with a cantilevered arm 130 for the sewing needle 140. As is known, the flat bed sewing head 110 has a pulley-based drive system 150. Other types of drive systems may be used herein. The flat bed sewing head 110 also one or more drive wheels 155 positioned about the work surface 120. The drive wheels 155 cooperate with one or more drive belts 156 so as to assist in driving the work piece 10 through the sewing needle 140.

As described above, the finishing apparatus 100 also includes a binding tape applier 160. The tape applier 160 generally includes a tape looper 170 for the binding tape 50 to be mounted thereon. The binding tape 50 is then driven via a tape feeder 180 and positioned about the work piece 10 via a tape folder mount 190. The tape folder mount 190 positions the binding tape 50 in a general "U" shaped configuration around the edges of the work piece 10 as is shown in FIG. 2. The U shape also can be folded to a "clean finish" that includes a tucked under fold, either on the top, bottom, or both sides. The binding tape applier 160 may be of conventional design. The binding tape applier 160 is positioned up stream of the flat bed sewing head 110.

The finishing apparatus 100 also includes a cutter assembly 200. The cutting assembly 200 may be driven from a shaft 210 connected to the pulley based drive system 150. The shaft 210 drives a first cutter arm 220. The cutter arm 220 has a knife 230 thereon. The cutter assembly 200 also may include a fixed lower knife 240. The cutter assembly 200 is positioned upstream of the bind tape applier 160. The cutter assembly may be synchronized with the action of the sewing needle 140. The cutter assembly 200 cuts from the back to the front and uses standard industrial sewing machine carbide blades. The cutter assembly 200 cuts one (1) time per sewing needle stitch. The length of the cut each stroke may be maximized such that the sewing feed may be as fast as possible.

The finishing apparatus 100 also includes a chain cutter 250. The chain cutter 250 includes a striker 260 driven by a Bimba 270 or similar types of drive means. The striker 260 may have a blunt edge so as to separate the chain of thread used for the stitches 60. Other types of separation means may be used herein. The thread chain cutter 250 is positioned downstream of the flat bed sewing head 110. As will be described in more detail below, the thread chain cutter 250 is particularly useful when producing a work piece 10 with rounded corners 40.

Figure 8:
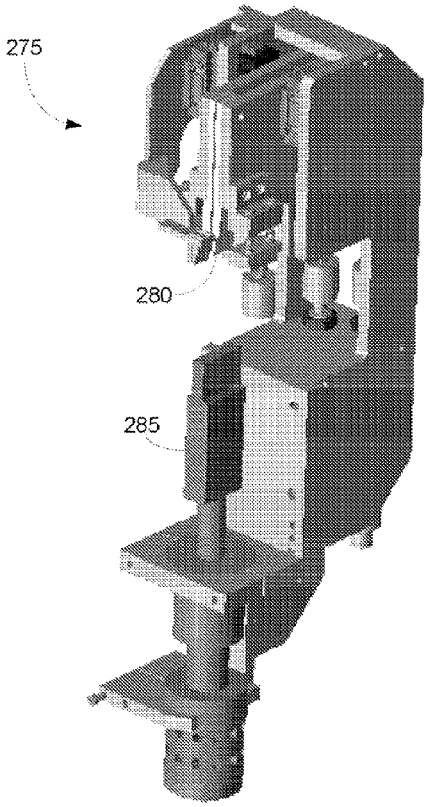
FIG. 8 is a perspective view of a binding tape cutter for use with the finishing apparatus of FIG. 3.

The finishing apparatus 100 also may include a binding tape cutter 275. As is shown in FIG. 8, the binding tape cutter 275 may be positioned downstream of the cutter assembly 200. The binding tape cutter 275 includes an upper anvil 280 and a lower sonic separator/sealer 285. The upper anvil 280 and the sonic separator/sealer 285 may operate at about twenty (20) KHz or so. The anvil 280 and the sonic separator/sealer 285 cooperate so as to cut the binding tape 50 and then sonically seal the square corners 30. The use of the sonic separator/sealer 285 also has the advantage that the plastic material of the binding tape 50 does not buildup about the anvil 280. The seal prevents the binding tape 50 and the chain from unraveling.

Figure 9:
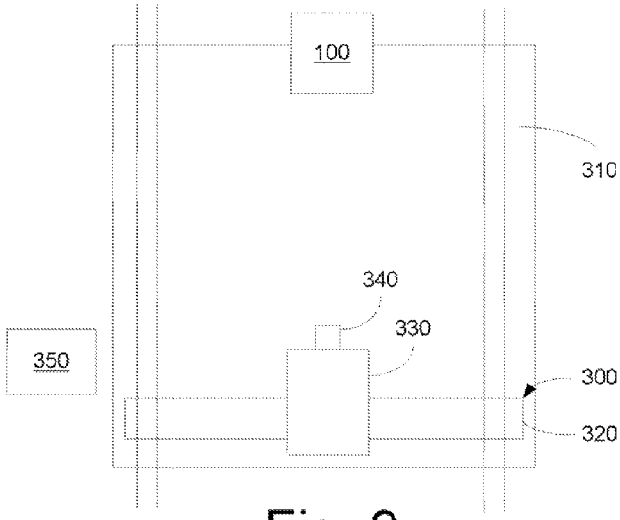
FIG. 9 is a schematic view of a maneuvering apparatus to be used with the finishing apparatus.

The finishing apparatus 100 may be used with a maneuvering system 300. The maneuvering system 300 may be of conventional design. The maneuvering system 300 may be any type of device that maneuvers the work piece 10 across a tabletop 310. In this example, the maneuvering system 300 may take the form of gantry arm assembly 320 with a template 330 or similar type of device as is shown in FIG. 9. The gantry arm assembly 320 allows the template 330 to move in the X and Y directions. Likewise, the template 330 may maneuver in the Z direction as desired. The maneuvering system 300 may include a number of visual sensors 340. The visual sensors may take the form of cameras, photo-optical devices, and similar types of devices. More than one type of visual sensor 340 may be used. An example of a maneuvering system 300 is shown in U.S. Pat. No. 5,619,942, entitled "Method And Apparatus For Finishing The Edges Of A Textile Product." U.S. Pat. No. 5,619,942 is incorporated herein by reference.

A programmable controller 350 may control operations of the components of the finishing system 100 as a whole. The controller 350 may be a conventional microprocessor or similar type of programming device. More than one controller 350 may be used herein.

The finishing apparatus 100 also may accommodate variations in the work piece 10 itself via one or more finishing algorithms that ensure that the actual dimensions of the work piece 10 are accommodated. For example, co-owned U.S. patent application Ser. No. 11/670,438, filed herewith, is entitled "System And Methods For Edge Measurement." This patent application is incorporated herein by reference.

In use, the work piece 10 is positioned about the finishing apparatus 100 via the maneuvering apparatus 300. The maneuvering system 300 maneuvers the work piece 10 through the cutter assembly 200. The cutter assembly 200 trims the work piece 10 into the desired final shape 20. As described above, the final shape 20 may include square corners 30 or rounded corners 40. Any desired shape may be used herein. Once the final shape 20 is cut, the tape applier 160 applies the binding tape 50 to the outer edge of the final shape 20. The binding tape 50 is then sewn into place via the sewing needle 140 of the flat bed sewing head 10. The maneuvering system 300 maneuvers the final shape 20 of the work piece 10 about the various edges so as to produce any desired shape. Once the binding tape 50 surrounds the entire perimeter of the final shape 20 of the work piece 10, the striker 260 of the chain cutter 250 cuts the thread from a work piece 10 with rounded corners 40. Likewise, the binding tape cutter 275 cuts the thread and the binding tape 50 about a work piece with square corners 30 and then seals the corners through the interaction of the anvil 280 and the sonic separator/sealer 285. The maneuvering system 300 then removes the completed work piece 10 from the finishing apparatus 100.

The finishing apparatus 100 thus has the ability to produce a work piece 10 that has square corners 30, rounded corners 40, or any desired shape. The combination of the flatbed sewing head 110 and the maneuvering system allows the formation of the rounded corners 40. The use of the binding tape cutter 275 allows for the formation and the sealing of the square corners 30 without the need for bar tacking. The finishing apparatus 100 thus provides for superior automation of the finishing of the work piece 10.

It should be apparent that the foregoing relates only to the preferred embodiments of the present application and that numerous changes and modifications may be made herein by one of ordinary skill in the art without departing from the general spirit and scope of the invention as defined by the following claims and the equivalents thereof.

I claim:

1. A work piece finishing apparatus, comprising:

a cutter assembly for cutting the work piece positioned on a work surface;

a binding tape applier positioned on the work surface; and a flat bed sewing head positioned on the work surface;

the flat bed sewing head comprising a cantilevered arm and one or more drive wheels to drive the work piece therethrough.

2. The work piece finishing apparatus of claim 1, wherein the binding tape applier comprises a tape folder.

3. The work piece finishing apparatus of claim 1, wherein the cutter assembly comprises a cutter arm with a driven knife thereon.

4. The work piece finishing apparatus of claim 3, wherein the cutter assembly comprises a fixed knife.

5. The work piece finishing apparatus of claim 1, further comprising a binding tape separator.

6. The work piece finishing apparatus of claim 5, wherein the binding tape separator comprises a sonic separator/sealer.

7. The work piece finishing apparatus of claim 6, wherein the binding tape separator comprises an anvil.

8. The work piece finishing apparatus of claim 1, further comprising a thread chain cutter.

9. The work piece finishing apparatus of claim 1, further comprising a maneuvering system so as to maneuver the work piece about the cutter assembly, the binding tape applier, and the flat bed sewing head.

10. The work piece finishing apparatus of claim 9, wherein the maneuvering system comprises a gantry arm assembly.

11. The work piece finishing apparatus of claim 10, wherein the gantry arm assembly comprises a template.

12. The work piece finishing apparatus of claim 11, wherein the one or more drive wheels cooperate with the maneuvering system.

13. A method for finishing the edges of a work piece, comprising:

trimming the edges of the work piece;

applying a binding tape to the edges;

stitching the binding tape;

removing any excess binding tape at one or more corners of the work piece; and sealing the one or more corners.

14. The method of claim 13, wherein the trimming step comprises cutting a square corner on the work piece.

15. The method of claim 13, wherein the stitching step comprises stitching the binding tape with a flat bed sewing head.

16. A method for finishing the edges of a work piece, comprising:

trimming the edges of the work piece;

applying a binding tape to the edges;

stitching the binding tape;

removing any excess binding tape at one or more corners of the work piece; and sealing the one or more corners;

wherein the sealing step comprises sonically sealing the one or more corners.

17. A method for finishing the edges of a work piece, comprising:

trimming the work piece to form rounded edges;

applying a binding tape to the edges;

stitching the binding tape with thread and a flat bed sewing head having a cantilevered arm and one or more drive wheels; and driving the work piece through the flat bed sewing head via the one or more drive wheels.

18. The method of claim 17, further comprising maneuvering the work piece across a tabletop and through the flat bed sewing head with a maneuvering system in combination with the one or more drive wheels.

19. The method of claim 17, further comprising removing any excess thread with a chain cutter.

20. A work piece finishing apparatus, comprising:

a cutter assembly positioned on a work surface;

a binding tape applier positioned on the work surface;

a flat bed sewing head positioned on the work surface;

the flat bed sewing head comprising a cantilevered arm and one or more drive wheels to drive the work piece therethrough; and a binding tape separator positioned on the work surface.

* * * * *